United States Patent [19]

Focke

[11] 4,269,559

[45] May 26, 1981

[54] APPARATUS FOR DISCHARGING CONTAINERS (TRAYS) FILLED WITH CIGARETTES AND THE LIKE

[75] Inventor: Heinz H. Focke, Verden, Fed. Rep. of Germany

[73] Assignee: Focke & Co., Verden, Fed. Rep. of Germany

[21] Appl. No.: 44,131

[22] Filed: May 31, 1979

[30] Foreign Application Priority Data

Jun. 2, 1978 [DE] Fed. Rep. of Germany ..... 2824149

[51] Int. Cl.[3] ..... B65G 59/08

[52] U.S. Cl. ..... 414/414; 414/421

[58] Field of Search ..... 414/421, 414; 53/148

[56] References Cited

U.S. PATENT DOCUMENTS

| | | | |
|---|---|---|---|
| 2,799,413 | 7/1957 | Innocenti | 414/414 |
| 3,298,549 | 1/1967 | Schmermund | 414/414 |
| 3,332,560 | 7/1967 | Niepmann | 414/414 |

*Primary Examiner*—Allen N. Knowles

*Attorney, Agent, or Firm*—Sughrue, Rothwell, Mion, Zinn and Macpeak

[57] ABSTRACT

An apparatus for transporting and emptying containers or trays of cigarettes including a pair of carrier arms which are adapted to recieve the containers and pivot them through a 180° angle such that the cigarettes may be emptied through an opening provided in the top of the container. After the container is emptied, the carrier is operable to return the container to its starting position, after which the carrier arms retract from the container so as to allow the same to be transported away. The carrier arms then return to the starting position to receive another container.

15 Claims, 9 Drawing Figures

Figure 1:
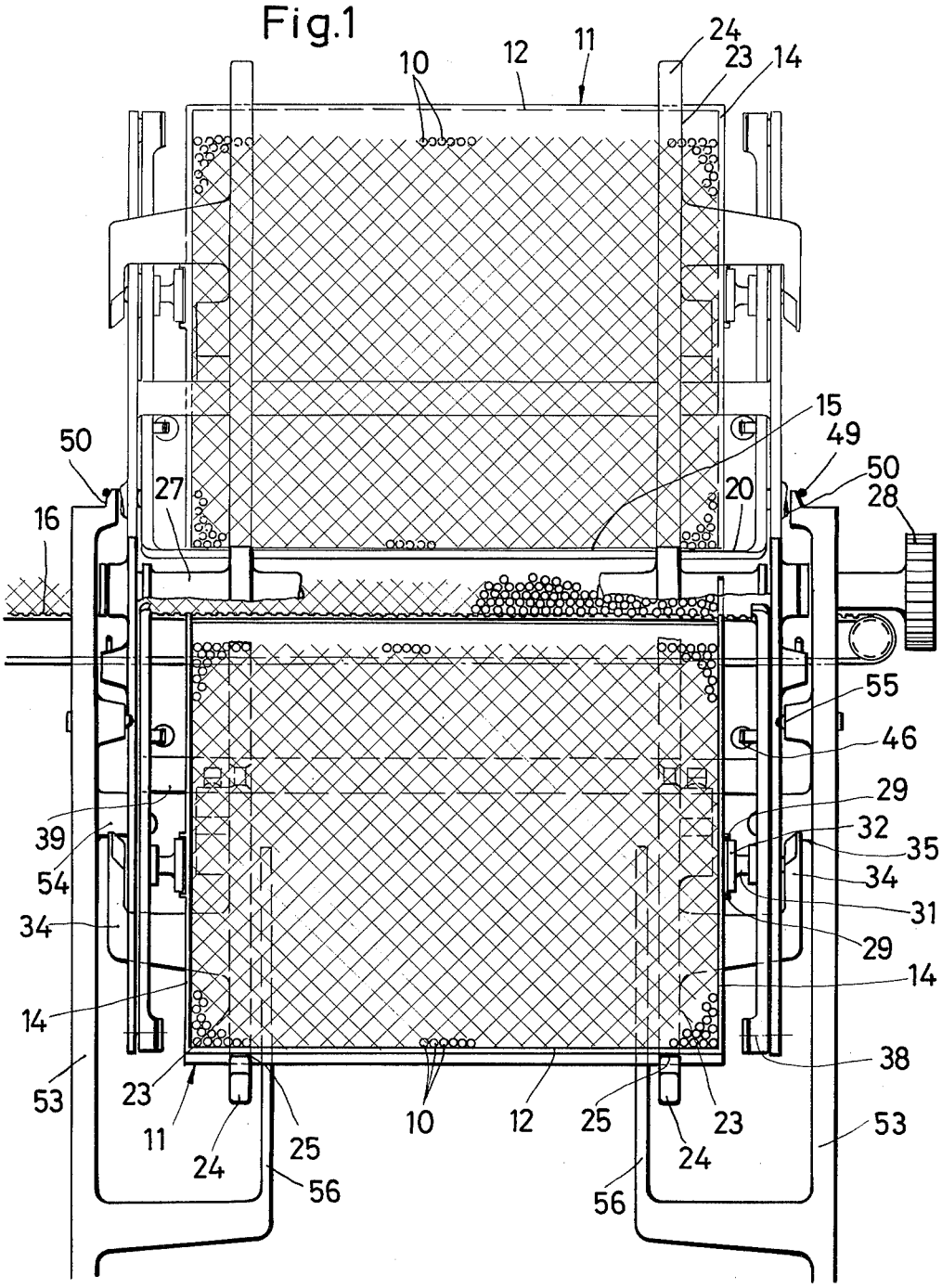

23
17
34
20
18
11
24
10
12
13
23
50
37
13
20
15
14
10
17
16
27
29
35
23
31
26
30
29
34
11
10
12
25
24
56
53

27
20
19
15
13
18
21
11
48
14
11
49
46
37
55
40
45
44
41
39
43
58
59
42
26
23
25
12
22
24
11
58

APPARATUS FOR DISCHARGING CONTAINERS (TRAYS) FILLED WITH CIGARETTES AND THE LIKE

The invention relates to an apparatus for transporting or transferring a group of rod-shaped articles, in particular cigarettes, which lie aligned and in close packing in a container (tray) or the like and undergo a tilting motion together with the latter, in particular for emptying the container.

The prime field of application of the invention is the emptying of rectangular containers, so-called trays, used in the cigarette industry, for receiving cigarettes. These containers which are relatively shallow, namely about one cigarette length deep, are open on two sides, namely on the front and on the top. The cigarettes lie aligned on a bottom wall, are laterally held by side walls and lie with one end against a rear wall.

As is known, the handling, namely the emptying of trays of this type, is effected by feeding the respective containers, more or less filled with cigarettes, to an emptying apparatus with the closed rear wall pointing forward in the conveying direction. The trays are tilted by the emptying apparatus in such a way that the opening which originally was at the top points downwards. Due to their mere weight, the cigarettes thus leave the tray.

The invention concerns a fundamentally new apparatus, with respect to the construction and the mode of operation, for handling trays or cigarettes during the emptying process.

It is the object of the invention to develop an apparatus of the type mentioned at the outset in such a way that the cigarettes or the like received in the container are not exposed to inadmissible mechanical or other stresses during the transporting or emptying process, in spite of short working cycles, and that falling over of the cigarettes is avoided.

To achieve this object, the apparatus according to the invention is characterized in that the cigarettes or the like are fixed in the container at least during one phase of the tilting motion thereof. In a preferred embodiment of the invention, an air cushion which can be inflated and evacuated enters into the tray in the zone of the free opening and fixes the cigarettes by exerting a slight pressure on the latter.

The particular advantage of this measure is above all that, even if the tray is only partially filled, the cigarettes are not mutually displaced during the tilting motion and cannot assume a random position, in particular largely independently of the degree of filling. This applies above all during the critical phase of the tilting motion when the container has moved beyond the horizontal position. Towards the end of the tilting motion, the pressure on the cigarettes is gradually reduced so that these reach the zone of the opening one after the other, in particular by an increasing reduction of the cross-section of the air cushion due to controlled evacuation.

The pressure element or the air cushion, which fixes the cigarettes during the tilting motion, is located on a special carrier, that is to say a blade which temporarily covers the upper opening of the tray and which, in the upper tilted end position of the container, is moved out of the zone of the opening which points downwards. The cigarettes can thus leave the container. During the pivoting motion into the starting position, the blade is again brought into a position in which the upper opening of the next (filled) tray fed in is covered.

The apparatus according to the invention is equipped with elements which can be moved relative to one another and which are controlled automatically, namely due to running-up against stops, by return springs and the like, in such a way that merely one central drive is necessary for effecting the tilting motions of the container, specifically in the form of a main shaft which rotates along a sector. A carrier for receiving a tray and for carrying out the tilting motion is mounted on this main shaft. Further elements, some of which also take part in the tilting motions, are associated with the carrier or the tray.

Figure 2:
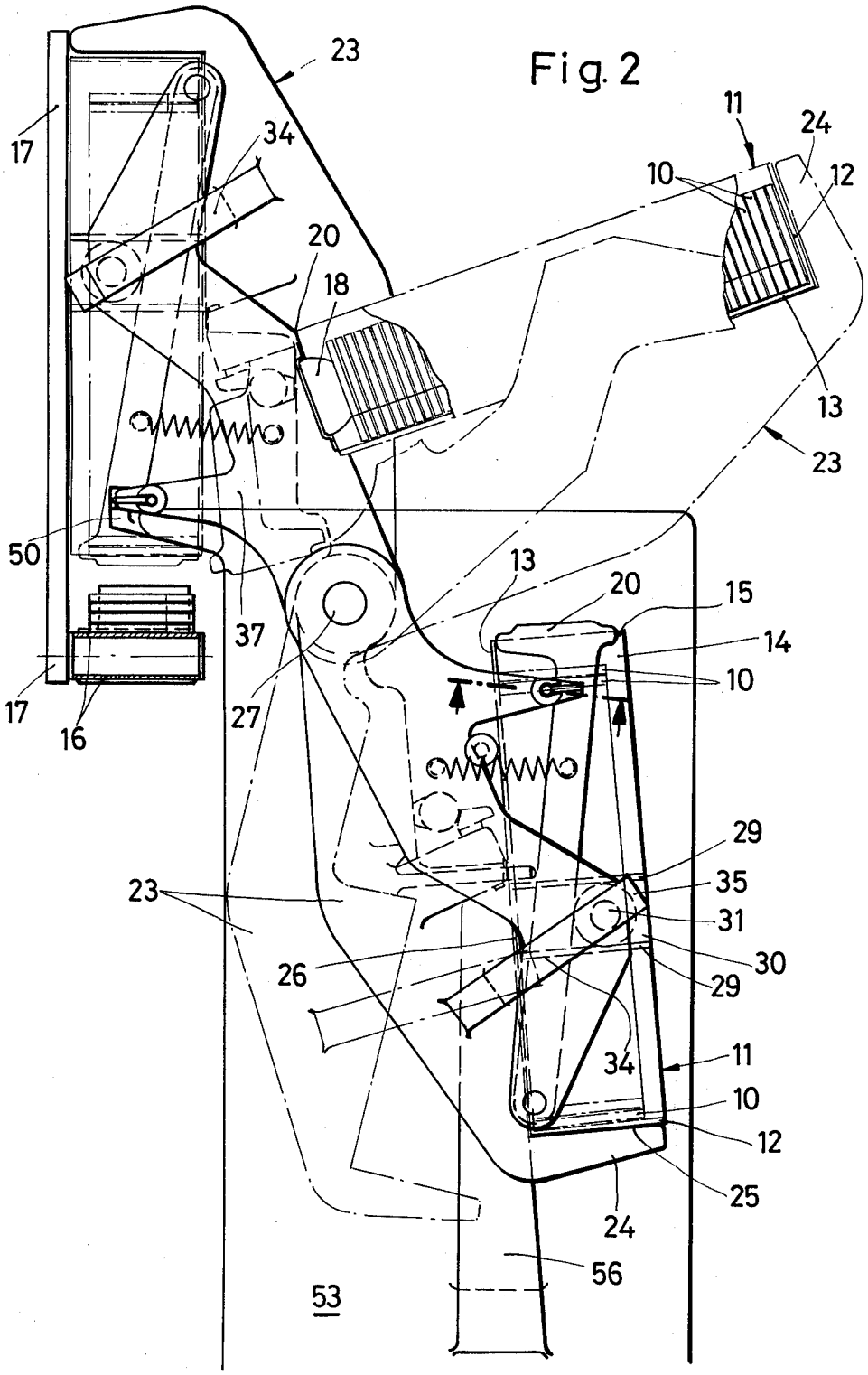
Figure 3:
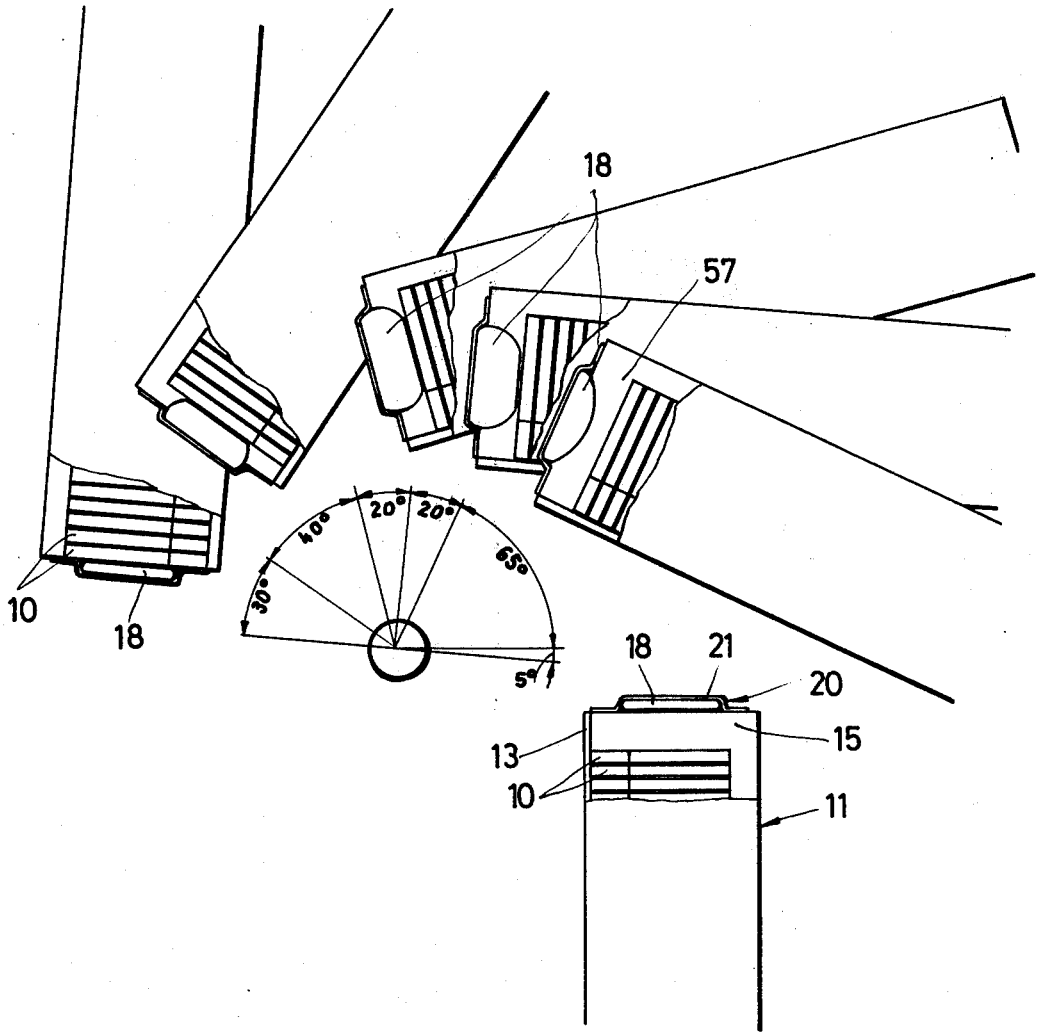
Figure 4:
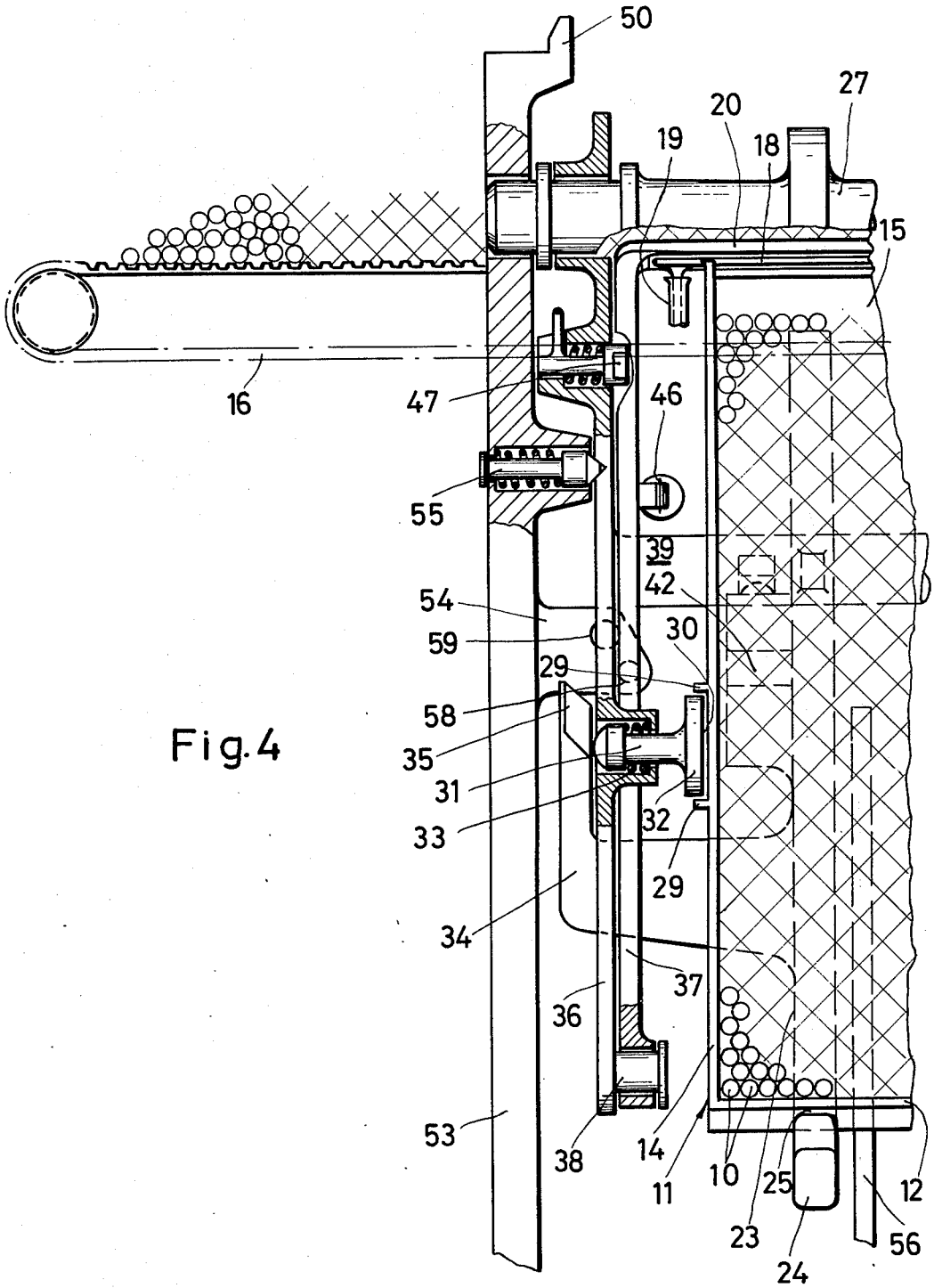
Figure 5:
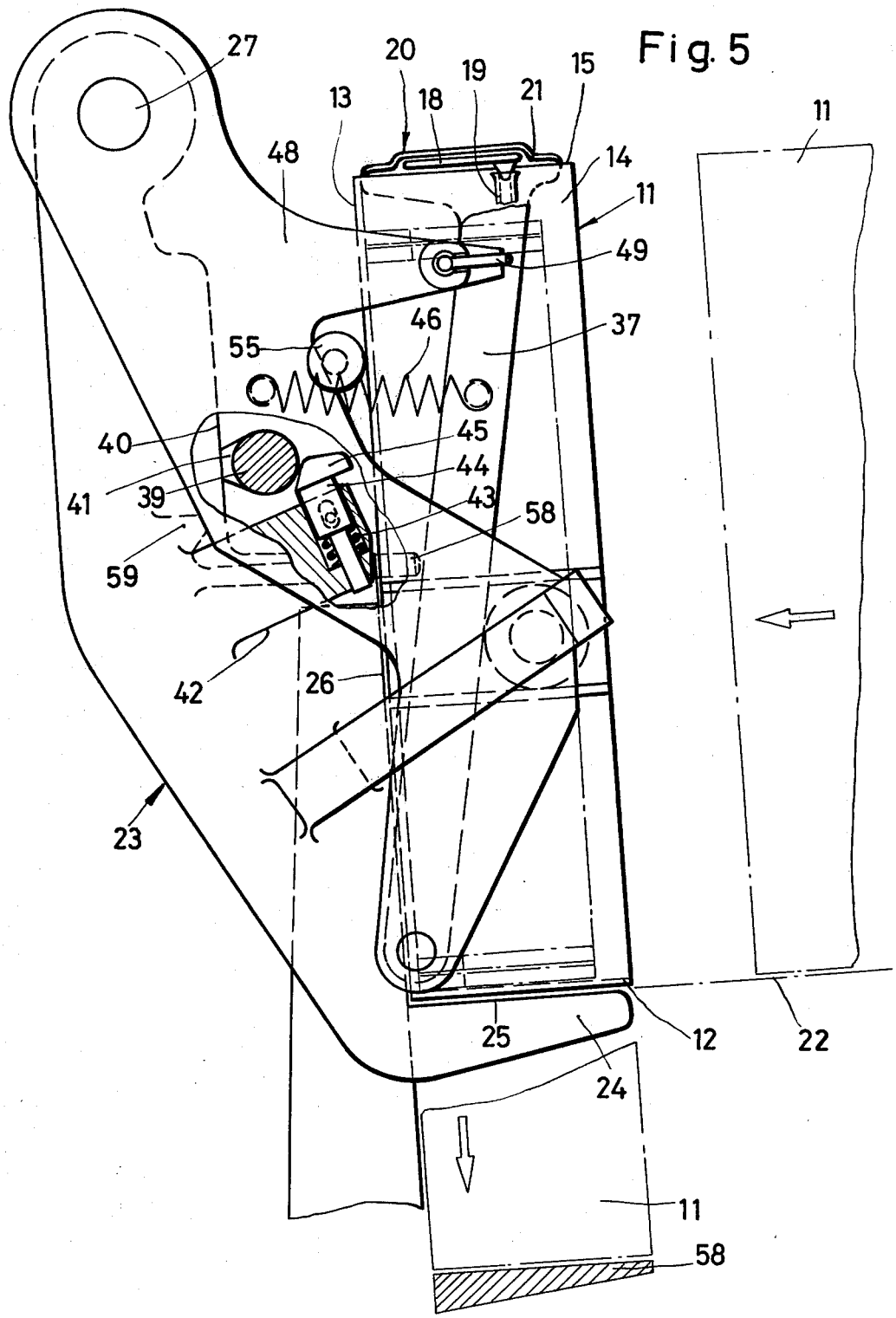
Figure 6:
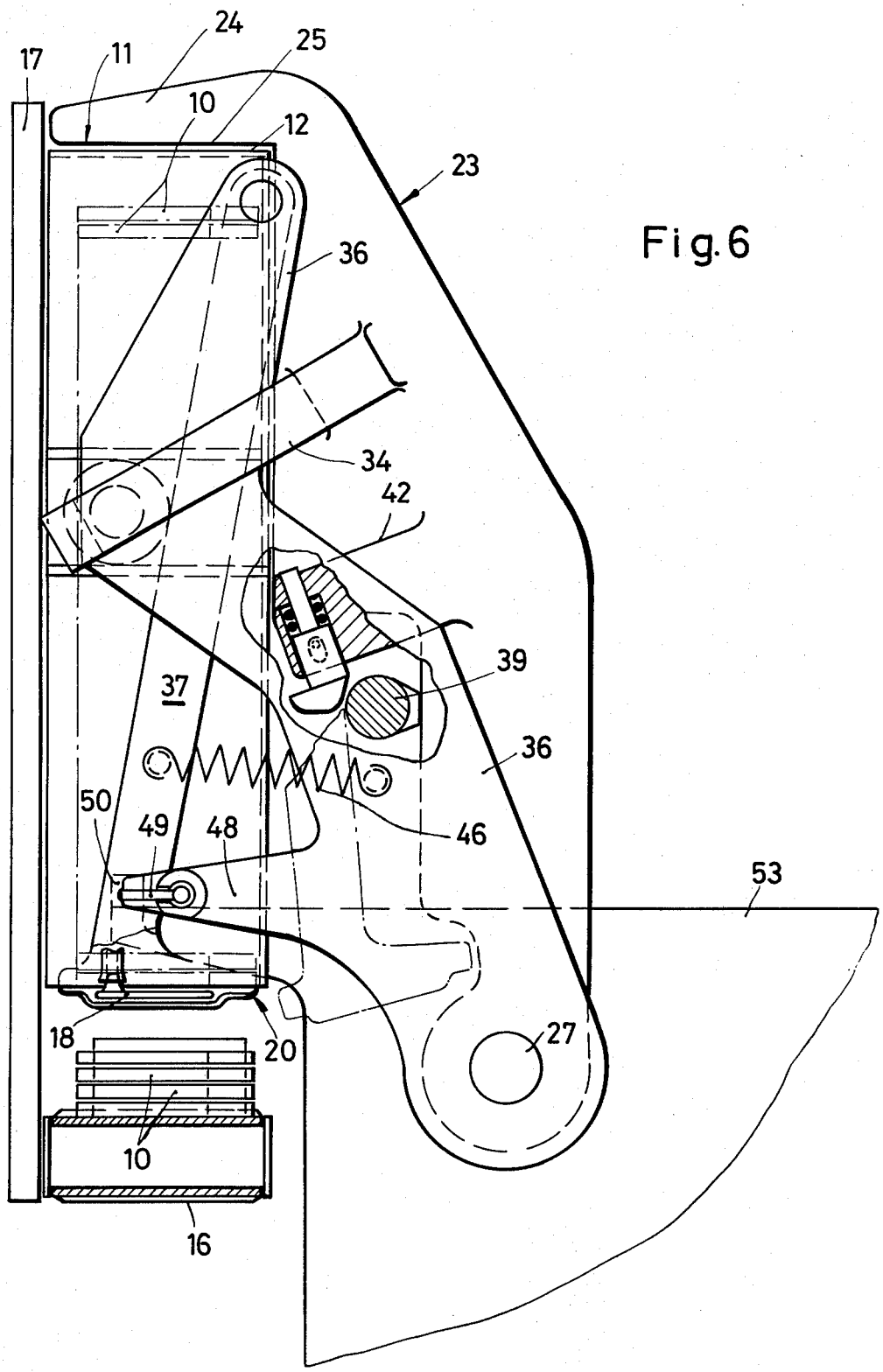
Figure 7:
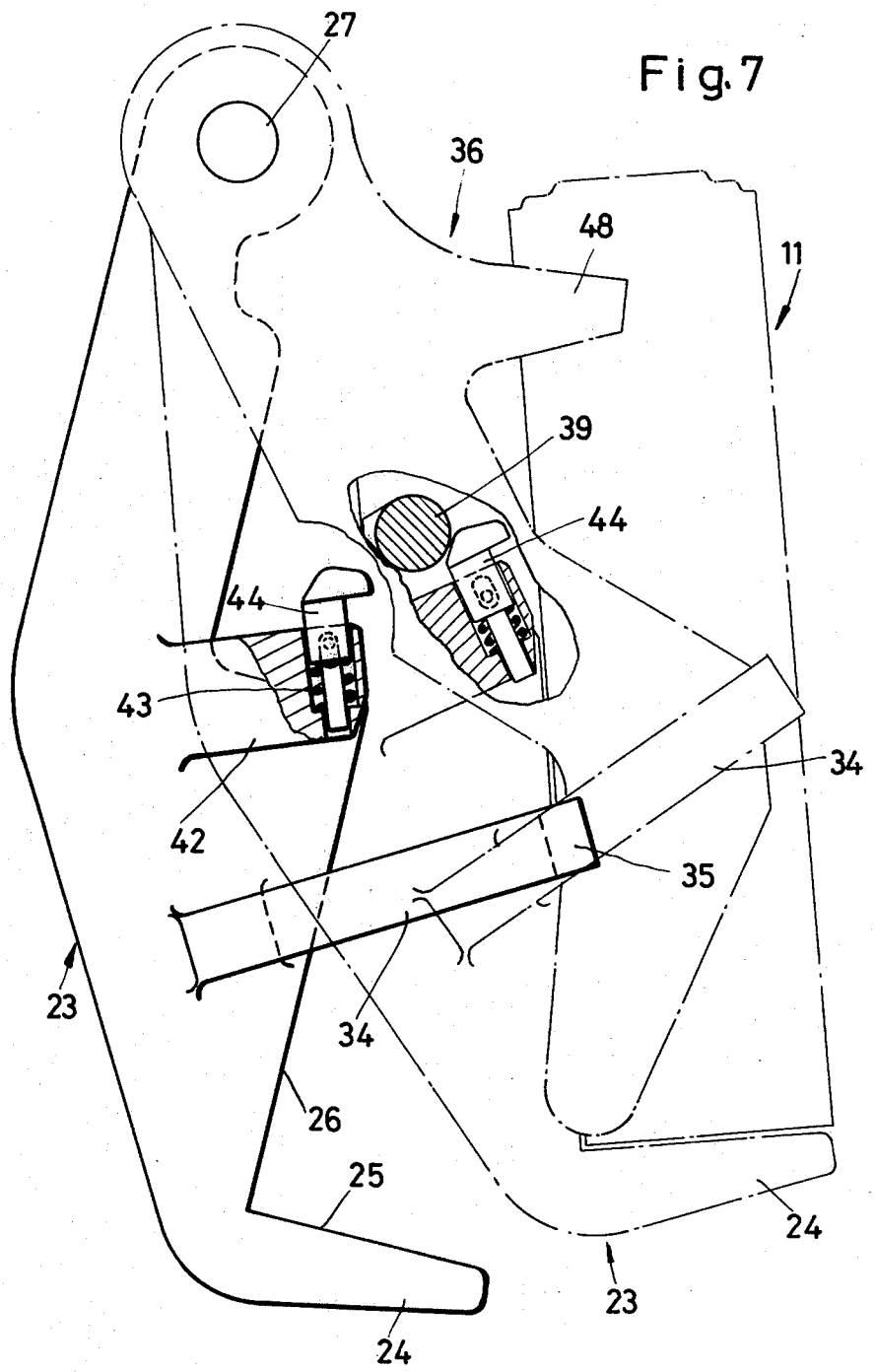
Figure 8:
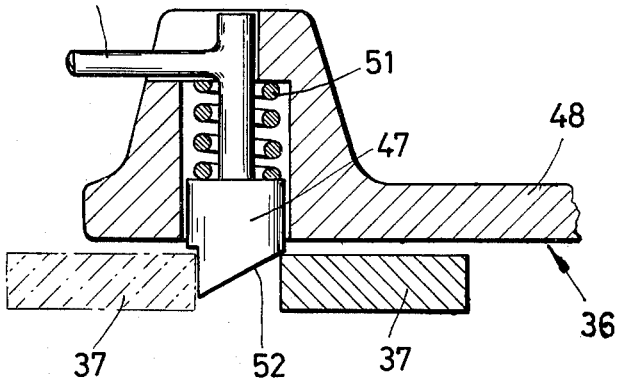
Figure 9:
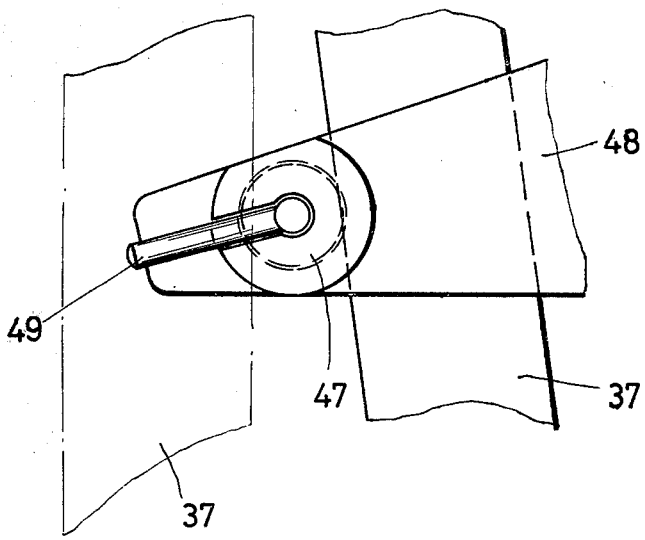

An illustrative embodiment of the apparatus according to the invention is explained in more detail in the following text by reference to the drawings in which:

FIG. 1 shows a front view of an apparatus for emptying cigarette trays,

FIG. 2 shows a side view of the apparatus according to FIG. 1 with intermediate positions of the tray, FIG. 3 shows the individual phases of motion of the tray during the tilting process, in a diagrammatic side view and partially in section, FIG. 4 shows a lateral cut-out of the apparatus in a view, partially in section, according to FIG. 1, FIG. 5 shows a side view of a detail of the apparatus with the housing jamb taken away or in vertical section, in the lower starting position when receiving a tray, on an enlarged scale, FIG. 6 shows a representation corresponding to FIG. 5 for the upper end position of the tray shortly before emptying, FIG. 7 shows a representation according to FIGS. 5 and 6 when releasing an emptied tray in the lower starting position, FIG. 8 shows a detail concerning the locking of a pivotable part of the apparatus in horizontal section, and FIG. 9 shows a side view of the detail according to FIG. 8.

The apparatus shown in the drawings deals with the emptying of containers 11, so-called trays, filled with cigarettes 10. The container 11 is formed by a bottom wall 12, a rear wall 13 and side walls 14. The front—opposite the rear wall 13—is open, as is the side which is at the top in the starting position, for example in FIG. 5, and which at the same time forms an opening 15.

A relatively large number of cigarettes 10 in an aligned position are received in the container 11. These cigarettes rest on the bottom wall 12 and one end face lies against the rear wall 13. The container 11 is filled with cigarettes almost to the rim of the container 11, that is to say up to the opening 15.

The point now is to empty this container 11 with the greatest possible time-saving and reliability. For this purpose, the container 11, which has been fed in in the position, for example, according to FIG. 5 is conveyed along a circular arc and simultaneously tilted in such a way that, in an upper end position (FIG. 6), the opening 15 points downwards. The cigarettes 10 now fall under their mere weight out of the container 11, in the present case onto a conveyor in the form of a cleated belt 16. The open front is covered in this upper end position by a stationary upright guide wall 17.

A particular feature of the apparatus is that the cigarettes 10 are fixed in the container 11 during the important phase of the tilting motion along a circular arc, specifically in such a way that, when the container 11 passes beyond the horizontal position, the cigarettes can neither prematurely fall out of the container nor perhaps get into a random tilted position.

For temporarily retaining the cigarettes 10 in the container 11, an elongate elastic pressure element in the form of an air cushion 18 is provided in the present illustrative embodiment. This air cushion enters into the opening 15 of the container 11 in such a way that, in the inflated state (see in particular FIG. 3), it is in contact with the row of cigarettes 10, which faces the opening 15 and was originally the upper row, and thus exerts a light, fixing pressure on all the material in the container.

The action of the air cushion 18 can be controlled by supplying air to the air cushion 18 or evacuating it, via an air connection 19. At the start of the tilting motion, the air cushion 18 is in the flat state within the opening 15. Subsequently, the air cushion 18 is gradually inflated in such a way that, at the latest, it is in contact with the cigarettes 10 when the container 11 enters the horizontal position (FIG. 3). During the continuation of the tilting motion, the air is discharged from the air cushion 18 in a controlled manner in such a way that the cross-section thereof is increasingly reduced. The cigarettes 10 in contact with the air cushion 18 are moved, due to their mere weight, one after the other towards the opening 15, corresponding to the reduction in the cross-section of the air cushion 18. In the upper end position (on the left in FIG. 3), the air cushion 18 has reached again the flat starting position. The cigarettes 10 have now been displaced up to a point immediately at the opening 15 and, after removal of the air cushion 18, can emerge from the opening.

The air cushion 18 is located on a carrier, namely a blade 20, which extends as an elongate structure over the entire length of the container 11 in the zone of the opening 15. The blade 20, for example formed from metal sheet, is provided with a depression-like recess 21. In the latter, the air cushion 18 is received in such a way that, when the air cushion 18 is folded up flat (for example FIG. 5), the air cushion 18 is about flush with the zones of the blade 20 outside the recess 21. This gives the cigarettes 10 a contact surface which is substantially at the same level.

The blade 20 can be moved relative to the container 11 and is mounted independently of the latter in such a way that the infeed and the removal of the container 11 and also the emptying are possible by retracting the blade 20 together with the air cushion 18.

The filled containers 11 are fed to the apparatus (for example FIG. 5) in the ready-to-receive position on a plane 22 of transport which has a slight fall in the conveying direction, that is to say which is inclined. The rear wall 13 is here in front in the direction of transport.

The container 11 fed in is received by a carrier which is in the ready-to-receive position and which consists of two carrier arms 23 located at a spacing from one another. Each carrier arm 23 is provided at the end, which is the lower in the receiving position, with a carrier leg 24, that is to say it has approximately the shape of an angle overall. The carrier leg 24 is aligned during the receiving position (FIG. 5) in such a way that a seating edge 25 thereof extends in the plane 22 of transport. After it has been received by the carrier arm 23, the container 11 is supported on the carrier leg 24 or on the seating edge 25 thereof. The seating edge 25 is adjoined under a right angle by an upright supporting edge 26 of the carrier arm 23. The rear wall 13 of the container 11 is in contact with this supporting edge.

The carrier arms 23 located at a spacing from one another are mounted on a common main shaft 27. The latter is in turn driven in a sense of rotation, in the present case via a spur gear 28 located at one end. The main shaft 27, together with the carrier arms 23, executes a rotary motion along a sector, and in particular from the receiving position according to FIG. 5 into the upper end position according to FIG. 6. During this pivoting motion, the carrier arms 23 take the container 11 along so that the latter follows the path of motion shown in FIG. 3.

When received by the carrier arms 23, the container 11 is associated with a further holder in this position. For this purpose, the container 11 itself is provided with holding means, and in particular in the present case with a holding slot 30 formed by two parallel ribs 29. A releasable coupling element which forms part of the apparatus and is a locking bolt 31 in the present case, enters into this holding slot during the transport and emptying process. While the container 11 is fed to the carrier arms 23, this locking bolt is held in readiness in the position which can be seen from FIGS. 4 and 5 and thus automatically enters into the holding slot 30 of the container 11 when the latter is fed in. The locking bolt 31 having a locking head 32 which enters frictionally into the holding slot 30 is continuously loaded by a compression spring 33 in the sense of unlocking. By means of a blocking bar 34 which is formed with an inclined run-up surface 35, the locking bolt 31 is held in the locking position, in particular by its free end bearing against the blocking bar 34. If the latter is retracted the locking head 32 emerges from the holding slot 30 as a result of an axial displacement of the locking bolt 31. In the present case, one blocking bar 34 is located on each carrier arm 23. Accordingly, the container 11 is fixed on the carrier arms 23 against an undesired up-and-down motion as long as the container 11 is in contact with the carrier arms 23.

Pivot arms 36 which are rotatably or pivotably mounted on the main shaft 27 are associated as auxiliary elements with the carrier arms 23. These pivot arms 36 located on the side next to the container 11 fulfil a plurality of functions, including coupling to the carrier arms 23 and decoupling from the carrier arms 23. Furthermore, the pivot arms 36 are holders for a blade holder 37. The latter consists of two holder arms which extend in one plane directly parallel to the plane of the pivot arms 36 and are pivotable relative to the latter. The ends of the blade holder 37, facing away from the blade 20, are pivotably joined via a bearing 38 to the free end of the pivot arms 36. On the side facing the main shaft 27 the holder arms of the blade holder 37 have a transition into the transversely pointing blade 20.

The elements described above, namely the carrier arms 23, the pivot arms 36 and the blade holder 37 or the holder arms of the latter are mutually locked in such a way that, during the tilting motions of the container 11, they follow the motion together, maintaining a defined relative position, but at the end of the motion phase, they are pivoted each time relative to one another.

In the receiving position according to FIG. 5, the carrier arms 23 on the one hand and the pivot arms 36 on the other hand are locked with one another via a cross-connection between the pivot arms 36, namely via a crossbeam 39. The carrier arms 23, formed with mutually offset zones, make contact, by a front edge 40, with the rear of the crossbeam 39, namely a nose 41 thereof. This contact position is ensured by an elastic barrier. For this purpose, the carrier arms 23 are provided with a lateral step 42. The latter receives an arresting bolt 44 which is axially displaceable against the pressure of a latch spring 43. The bolt head 45 of the arresting bolt, formed with a chamfered contact surface, accordingly bears against the front of the crossbeam 39 in an elastically yielding manner. As a result of this elastic coupling, the carrier arms 23 can be moved clockwise relative to the pivot arms 36, into a position according to FIG. 7. At the same time, the arresting bolt 44 is moved with axial displacement past the crossbeam 39 which remains in the position shown.

Furthermore, the pivot arms 36 on the one hand and the blade holder 37 or the holder arms thereof on the other hand are locked with one another. A tension spring 46 extends between the two said elements. The pivot arm 36 which is angled off several times makes contact, in a zone remote from the bearing 38, with a movable stop member 47 due to the action of the tension spring 46 on the blade holder 37 or the holder arm thereof (see also the dotted-and-dashed position in FIG. 8). The relative position, which thus results and which can be seen in particular in FIGS. 5 and 6, between the pivot arms 36 and the blade holder 37 is maintained in the lower position and also during the tilting motion.

When the upper end position is reached (FIG. 2 or FIG. 6), the stop member 47 fitted on a projection 48 of the pivot arm 36, or a transversely pointing and projecting acutating lever 49 thereof, runs up on a stationary abutment 50. The stop member 47 is formed as an axially displaceable latch with an oblique glide surface 52. As a result of the actuating lever 49 running up on the abutment 50, the stop member 47 is axially displaced against the pressure of a spring 51 in such a way that, when the stop member 47 is retracted, the blade holder 37 can pivot from the dotted-and-dashed position in FIG. 8 into the position drawn in full lines, in particular under the action of the tension spring 46. The blade holder 37 thus executes an anti-clockwise motion in such a way that the blade 20 is pivoted back from the zone of the opening 15 into a position which frees the latter.

The above-described movable elements of the apparatus are joined to a stationary framework, mainly by the main shaft 27. The framework consists of lateral fixed housing jambs 53 in which the main shaft 27 is rotatably mounted.

The abovementioned housing jambs 53 likewise receive a number of elements. Thus, the stationary abutment 50 for the release of the blade holder 37 is located at the upper end of the housing jamb 53. Moreover, fixed stop noses 54 are located in each case on the side of the housing jamb 53, facing the pivot arm 36, which stop noses lie outside the zone of motion of the carrier arms 23 in the plane of motion of pivot arm 36 and blade holder 37. In the lower position (for example FIG. 2 and FIG. 5), the abovementioned elements make contact with the stationary stop nose 54.

To secure the above-described contact of the pivot arms 36 on the stop nose 54 in the lower position, a spring-loaded bolt 55 is also located in each case on the housing jambs 53, which spring-loaded bolt releasably grips the pivot arm 36 on the side opposite the stop nose 54 and fixes it before the start of the tilting motion.

Moreover, angular stop arms 56 which lie outside the planes of motion of the pivot arms 36, the blade holder 37 and also the carrier arms 23, namely between these, are fitted on the housing jambs 53. The stationary stop arms 56 serve as an additional orientating stop for the container 11 in the lower position according to FIG. 2, and in particular, above all, when the tilting device returns into this receiving position.

The apparatus described to this extent functions as follows:

In the receiving position according to the bottom of FIG. 2 or according to FIG. 5, a container 11 is introduced on the plane 22 of transport into the tilting device which is open on this side, namely into a receptable formed by the carrier arms 23. In this position (FIG. 5), the container 11 is automatically locked and fixed by the locking bolt 31 which enters into the holding slot 30 between the ribs 29 of the container 11. The blade holder 37 and the blade 20 are then in a position in which the upward-pointing opening 15 of the container 11 is covered.

The tilting motion is now initiated by turning the main shaft 27. The drive from the main shaft 27 is transmitted directly to the carrier arms 23. The latter take the other elements along—via the crossbeam 39 and so on.

As soon as the container 11 approaches the critical position, namely the horizontal position, during the tilting motion along a circular arc, the air cushion 18 is inflated so that the hollow space 57, which still remains after filling the container 11, above the cigarettes 10 is filled up by the air cushion 18. The latter prevents the cigarettes 10 from falling over into this hollow space 57 during the further motion of the container 11.

While the container 11 approaches its upper end position, the volume of the air cushion 18 is increasingly reduced, as a result of which the cigarettes 10 follow one after the other into the zone of the hollow space 57. In the end position (on the left in FIG. 3), the air cushion 18 has returned into the flat starting position, and all the material in the container 11 now rests on the blade 20 which acts as a bottom surface.

The blade is then automatically retracted from the zone of the opening 15 in the manner which has been described. The cigarettes 10 now leave the container 11 under the action of their mere weight.

After the container 11 has been emptied, the latter is moved back into the starting position by means of the tilting device. The lower end position are receiving position for the container 11 is here determined by the stationary stop arms 56. The corresponding receiving position for the pivot arms 36 and the blade holder 37 is fixed by the contact on the stop nose 54. Merely the carrier arms 23 are pivoted clockwise beyond this receiving position further into the position according to FIG. 7 (fully drawn lines) by the corresponding rotary motion of the main shaft 27. The locking of the carrier arms 23 to the pivot arms 36 is thus overcome in the manner described. In this pivoted-back position, the carrier arms 23 are free of the container 11. The latter is now received by a downward-conveyor 60 and transported away in the downward direction.

The carrier arms 23 are then pivoted back into the receiving position (FIG. 5); the next filled container 11 can be fed in.

The return motion of the tilting device into the lower starting position or receiving position also effects a return of the blade holder 37 with the blade 20 into the starting position. For this purpose, the stop nose 54 is designed with a projecting stop pin 58 which extends towards the pivoted-back blade holder 37. The differences in dimensions relative to a corresponding stop pin 59 for the pivot arm 36 are selected in such a way that the blade holder 37 is prematurely stopped in its pivoting motion and, while the pivot arm 36 moves further, is pivoted clockwise relative to the latter. During this relative motion, the blade holder 37 passes from the position shown in FIG. 8 in fully drawn lines into the starting position shown by dashed lines. The edge of the blade holder 37 thus glides along the inclined glide surface 52 of the stop member 47 with axial displacement of the latter.

The elements of the tilting device, in particular the carrier arms 23 and pivot arms 36, and their mutual coupling, can also be employed in an apparatus which is designed, for example, without a blade or other devices for fixing the cigarettes 10.

I claim:

1. In a device for transporting and emptying a container containing rod-shaped articles, particularly cigarettes, by rotating the container through an angle approximating 180° such that an opening disposed at the top of the container is turned downwardly, the improvement comprising;

(a) carrier means (23) for receiving said containers from a delivery station and for transporting them to an emptying station, said delivery station being located in a transport plane (22) vertically below said emptying station (16), (b) said carrier means including angled arms (24) for receiving the bottom of a container thereon, (c) said carrier means being pivotable about an angle approximating 180° with said container, (d) said carrier means being operable to return said container, after emptying, to the position in which it was received, (e) said carrier means being retractable, in a direction opposite from the delivery direction, after returning said container to said received position, whereby the container is removed from said carrier means.

2. A device as claimed in claim 1, further comprising a conveyor for receiving the containers removed from said carrier means, and for transporting the emptied containers away from said receiving station.

3. A device as claimed in claim 1, wherein said angled arms (24) are provided with flat surfaces (25), on which a floor wall (12) of the container seats.

4. A device as claimed in claim 3, further comprising a releasable coupling (44), which, in its locked position, allows said container to seat upon said angled arms (24), said coupling being releasable to allow said retraction of said carrier means.

5. A device as claimed in claim 1, further comprising pivot arms (36) located alongside said container (11) and movable therewith, and a main shaft (27) for supporting said carrier means and said pivot arms.

6. A device as claimed in claim 5, wherein said pivot arms (36) are provided with a detent bolt (31) attached thereto, said detent bolt being engageable with a guide slot (30) provided on the side walls (14) of the container (11).

7. A device as claimed in claim 6, wherein said detent bolt (31) is detachable from said guide slot to allow the container (11) to be moved downward, when said carrier means are retracted.

8. A device as claimed in claim 7, wherein said carrier means (23) and said pivot arms (36) are detachably locked to one another.

9. A device as claimed in claim 6, wherein said pivot arms (36) are connected to one another by a cross bar (39) extending therebetween, said cross bar being located behind said container and in front of said carrier means.

10. A device as claimed in claim 9, wherein the relative position between said carrier means (23) on the one hand and said pivot arms (36) on the other is determined by the attachment of the carrier means (23) to said cross bar (39).

11. A device as claimed in claim 9, wherein said carrier means (23) is secured to said cross bar (39) by an elastically movable stop bolt (44), said stop bolt (44) being disengaged when said carrier means is retracted.

12. A device as claimed in claim 1, wherein an opening (15) of the container (11) is covered by a blade member (20) which is movable into and out of engagement with said container.

13. A device as claimed in claim 12, wherein said blade member (20), extends along the entire length of the container (11) and is connected to a pivoting holder adjacent the narrow sides (14) of the container (11).

14. A device as claimed in claim 12, further including means for moving said blade member away from the opening (15) of the container (11) when the container is in the emptying position, said moving means comprising a pre-stressed tension spring (46).

15. A device as claimed in claim 1, further comprising an inflatable air cushion (18) arranged within the opening (15) of said container, said cushion serving to secure the cigarettes (10) within the container (11) when the container (11) is only partially filled.

* * * * *